US009074763B2

(12) United States Patent
Begg

(10) Patent No.: US 9,074,763 B2
(45) Date of Patent: Jul. 7, 2015

(54) SPILL PROOF ALCOHOL BURNER

(76) Inventor: Scott Begg, New Orleans, LA (US)

( * ) Notice: Subject to any disclaimer, the term of this patent is extended or adjusted under 35 U.S.C. 154(b) by 764 days.

(21) Appl. No.: 13/200,733

(22) Filed: Sep. 29, 2011

(65) Prior Publication Data

US 2013/0084533 A1 Apr. 4, 2013

(51) Int. Cl.

| | |
|---|---|
| ***F23D 5/12*** | (2006.01) |
| ***F23Q 25/00*** | (2006.01) |
| ***F23D 5/04*** | (2006.01) |
| ***F23D 5/14*** | (2006.01) |
| ***F23D 5/16*** | (2006.01) |

(52) U.S. Cl.
CPC *F23D 5/12* (2013.01); *F23Q 25/00* (2013.01); *F23D 5/04* (2013.01); *F23D 5/14* (2013.01); *F23D 5/16* (2013.01)

(58) Field of Classification Search
CPC ..... F23D 2700/03; F23D 5/00; F23D 5/04; F23D 3/00
USPC ..... 431/146, 331, 338, 323
See application file for complete search history.

(56) References Cited

U.S. PATENT DOCUMENTS

| | | | | |
|---|---|---|---|---|
| 5,199,413 | A * | 4/1993 | Chen | 126/43 |
| 5,280,150 | A * | 1/1994 | Arai et al. | 219/726 |
| 2005/0178379 | A1* | 8/2005 | Weinberger | 126/500 |
| 2005/0227194 | A1* | 10/2005 | Weinberger | 431/331 |
| 2006/0056174 | A1* | 3/2006 | Sun | 362/161 |
| 2011/0070551 | A1* | 3/2011 | Jin | 431/344 |

* cited by examiner

*Primary Examiner* — Avinash Savani
(74) *Attorney, Agent, or Firm* — Keaty Law Firm

(57) ABSTRACT

A portable alcohol burner is designed to use ethanol as a fuel for indoor/outdoor settings. The burner has a fuel chamber filled with ceramic fiber filler permeated with alcohol. A perforated baffle cage is fitted in the housing and is completely surrounded by the filler material. As alcohol vapors escape from the fuel chamber and rise through the perforations in the baffle cage they can be ignited to create a desired pleasing flame pattern.

12 Claims, 4 Drawing Sheets

SPILL PROOF ALCOHOL BURNER

BACKGROUND OF THE INVENTION

The present invention relates to an alcohol burner and, more particularly, to a unit that can be used as an insert in fireplace or as a stand-alone unit and, more particularly, to an alcohol burner that uses liquid alcohol as a fuel source.

Primary factors that determine suitability of alternate methods of producing fire in the home for warmth and aesthetic ambience include venting abilities and safety. The first critical decision that a consumer makes when choosing a type of home fire product is the cost of installation and whether there is an existing vented area in the home. The cost of installation is the first step. Chimneys for exhausting unfriendly fuels (gas, wood) are expensive to install and maintain. Installation of vents/chimneys is not always possible/practical in all types of dwellings (older homes, apartments, loft conversions, etc.). Many parts of the country now prohibit log fire chimney operation due to fire hazard and pollution concerns. Municipal standards and building code requirements are becoming increasingly difficult and costly to meet. Some newer gas fire models use sophisticated internal air filtering and Cot detection equipment to preclude the need for exhaust chimney, but these solutions are still quite expensive to install.

Additionally, the cost of operation needs to be considered. There is no doubt that for high volume home heat production via a live fire feature, that natural gas is the cheapest per Btu hour. However, for all fuels that require ventilation (gas, wood pellets, logs, etc.), it is important to factor in heat energy lost through venting. Also, fixed location fires often lead to surplus heating being created in one area of the dwelling in order to facilitate heat spilling over into the desired area of the residence. Therefore in many instances, the use of a fuel such as alcohol, that is more expensive per BTU of energy—can actually prove to be comparatively affordable to use in certain home use situations. Because alcohol is a clean burning, ventless fuel, it cannot lose heat due to chimney venting—and it can be used in the precise location where warmth is desired by the user which ensures direct benefit of heat energy produced. Because portable alcohol fires can be quickly turned on and off and many can be adjusted for variable heat settings, they can be an excellent secondary source of direct warmth in conjunction with a larger heating system such as central heating/forced air supplied by a home furnace. A typical user can set the furnace thermostat lower (thereby achieving significant savings on the primary heating bill) and then use room specific portable alcohol heaters—and the blended result can be a lower total heating costs as compared with furnace heating alone, or as compared with furnace heating used in conjunction with a gas, log or pellet fire. However, if a user does not have a primary heat source in the home, alcohol fires would not be an affordable primary source of home heating.

Still another consideration is whether to select portable versus fixed location for the fire burner. Apart from the above mentioned considerable cost factors associated with installing fixed location vented fires, there is a strong usage preference by many users in favor of portable fire features that can be moved to different areas of the dwelling. As single portable fire feature can act as living room fire, bedroom fire, sit by the side of bathtub or be moved to an outdoor deck or garden setting. This creates great versatility in terms of both the aesthetic ambience created by the live flame, and also in terms of delivering immediate warmth when and where desired. However, it should be noted that this portability feature depends greatly on a) the safety features of the portable burner unit and b) the suitability of the fuel it uses—in terms of exhaust, and also ease of handling in a home environment. Liquid alcohol is far superior to any other fuel type for portability as it is the only fuel that addresses all of these concerns.

Environmental factors when choosing a home product are increasingly important. Liquid alcohol is the hands-down winner against all other possible fuel types that can be used for producing natural home fire.

Conventional wood burning fireplaces are becoming a thing of the past. When incorrectly constructed, such fireplaces produce smoke in a living space. Even if correctly built, conventional fireplaces cause chimney creosote buildup, which must be regularly removed. Ashes resulting from burning of wood often spill into the living space, requiring the home owner to clean not only the fireplace but also the surrounding areas and furniture. To solve these problems, the industry developed various alternatives, such as fixed supply line natural gas fireplaces, propane fueled fire pits, gel pot portable fire features, gel fuel fireplace burners, and poorly designed alcohol fire burners. Such conventional solutions suffer from many shortcomings. It should be noted that the heat produced by alcohol in gel and liquid form is roughly the same in both forms of the fuel—when flame size is comparable. Gas fires produce heat dependent on the size of the burner, the capacity of the supply line and the adjustment of the control valve. A log fire can produce anywhere between 500 btu and 50,000 btu for a raging 6 log fire, but most normal users find 10,000-20,000 btu comfortable for a sustained period of time. A good portion of this energy is lost through the chimney exhaust. Gas fireplaces can be turned down as low as 3,500 btu and many can be turned up as high as 35,000 to 45,000 btu, but this is too much heat for most living rooms, so unless there is a heat ducting system to share the heat with other parts of the house, most living room settings would settle for around 15,000 btu (and again, lose some of this up the chimney).

All of the above factors combine to inform the basic distinction between fixed and portable fire features. Once a purchaser has determined that they desire a portable fire feature that can be used indoors, the field of possibilities is narrowed to just gel alcohol and liquid alcohol used by indoor alcohol burners, and even more narrowly to ethyl alcohol and isopropyl alcohol. Ethyl alcohol is made from food crops such as corn or sugar cane. Isopropyl alcohol is very commonly available—but not nearly as well suited for home fires because of its potentially harmful exhaust. Isopropyl alcohol is made from by-products of refined fossil fuels (natural gas or oil) and this is why it releases higher levels of Co2 than ethyl alcohol. It also produces some Carbon Monoxide and also other noxious emissions—which is why it is not favored for humans to breath its exhaust indoors (ethyl alcohol produces no Carbon Monoxide). Gel alcohol fire fuel is mainly made from isopropyl alcohol—and as such, it is better suited either to outdoor use or for use in vented traditional fireplaces that have chimneys (this is the way many of the common cartridge gel alcohol fire systems are marketed—as fireplace replacements for vented hearths).

Liquid Isopropyl alcohol (aka rubbing alcohol) is widely available at pharmacies and hardware stores—and it will burn (producing a blue flame)—but indoor fire users complain of headaches and drowsiness when exposed to it for even a moderate period of time.

Methyl alcohol (aka methylated spirits) is widely available; it is made from wood by-products. It produces a flame similar to ethyl alcohol, but the primary reason it is not recommended for fireplaces is that it is highly poisonous when consumed orally—and so having it in the home environment is a greater risk compared with ethyl alcohol—and since ethyl alcohol is cleaner and greener, there is no reason to consider the less common methyl alcohol as a fireplace fuel.

Gel alcohol is generally considered more hazardous than liquid because it is prone to splatter under certain circumstances, and when it does, it sticks to human skin and is difficult to extinguish. The U.S. Consumer Product safety Commission (CPSC) recently announced a general recall for all pourable gel alcohol fuels intended for use with fireplace type products because of the high likelihood of consumer misuse—when pouring the gel into a hot container or onto a flame that the user thought had already been extinguished, splatter and fire hazard can easily result. It is important to note that this recall does not pertain to canister formats of gel fuel. Additionally, gel fuel uses emulsifiers and other additives that result in a sooty crust by-product of burning—and this is messy and unsightly in addition to creating an odor that many find to be unpleasant. Conversely, when liquid alcohol is burned, there is no soot, no residue, no crust and no odor.

Gel alcohol (isopropyl) can typically only be used indoors to create small "table top" fires—due to the exhaust it emits. Exhaust produced from a small can of gel alcohol is unpleasant, but in a good sized open area most people will not suffer ill effects. But for a larger fireplace type fire effect, gel alcohol should be limited to use in a vented fireplace hearth type setting.

As to the safety factor: the safety risks for other home fire fuel types are well known (gas fire places blow up houses and poison people in their sleep when they leak unburned gas, log fires cause chimney and roof fires, etc.). but once a user has determined that their needs are best met by a versatile, portable ventless fire, and once the issue of exhaust and environmental concerns have been considered (e.g. clean burning alcohol versus other, less clean fuels), the focus of selection should be the distinction between gel and liquid alcohol, and then between simple, rudimentary burner design for liquid alcohol versus sophisticated, advanced designs for alcohol burners. It was earlier perceived by many that gel alcohol would be easier for users to handle, and therefore safer than liquid alcohol. However, since being widely introduced to the marketplace, gel alcohol had much higher reported incidents of accidents. But the main factor is the propensity of gel to splatter when it comes in contact with a surface that is much hotter than the gel alcohol—and this is something that can happen as a result of consumer misuse. When accidents do happen with gel alcohol, they are particularly harmful to people because of the way hot gel alcohol can stick to human skin. It is now generally understood and accepted by the industry that liquid alcohol is much more stable and predictable and therefore safer when used in the right type of burner device.

It is worth noting that one of the advantages of many alcohol burners over other fire feature types, is that because they are compact and portable (and ventless) they can be installed in ways that make them much more visible to home users than ever before possible. The optimal application of a home fire is to provide and equal balance of cozy warmth with the visual stimulation of watching a flame dance. Most fireplaces do not afford a clear sightline to the fire from many vantage points. A hearth allows for only very limited viewing from the front side and often at a distance from where people are standing or sitting. A portable alcohol fire feature can usually be viewed from all four sides, and can be positions in an unlimited variety of positions in proximity to home user. This is probably one of the most important features that users cite as their reason to buy a portable fire feature over the other traditional alternatives. Until now, perceived safety was the main barrier to adoption by users who wanted to place a fire closer to their favorite places to spend time in their homes—but they were afraid to do so.

However, it should be noted that many early generation burners on the market which use liquid alcohol have important limitations in terms of their safety features.

A known alcohol fire burner is disclosed in U.S. Pat. No. 7,287,979 issued on Oct. 30, 2007 for "Burner for a heater." This burner comprises a combustion chamber having a combustion zone for combusting the hydrocarbon liquid and at least one tank portion for containing an amount of the hydrocarbon liquid. Each tank portion is positioned adjacent the combustion zone and is arranged to feed the hydrocarbon liquid into the combustion zone. A combustion control is designed to control gas exchange of the combustion zone through a gas exchange opening of the combustion chamber, wherein the burner is arranged so that the fuel inlet opening is only fully open when the combustion control means closes at least a portion of the gas exchange opening of the combustion chamber. This design presents a typical solution of conventional alcohol burners; it is arranged for the combustion of ethanol or methylated spirits. The tank portions are filled with stainless steel wool which distributes heat and reduces likelihood of ignition in the tank portions and thereby reduces formation of air pockets within the hydrocarbon liquid. However, stainless steel wool has a limited absorption capability, making this type of burner hazardous. Additionally, this burner is likely to create large pockets of trapped alcohol vapor mixed with oxygen and allow these pockets to remain stored in compartments in the device—creating a vapor cloud that flares dramatically upon ignition. This can not only be frightening to consumers, it can lead to unexpected flashes of flame that can ignite clothing or other nearby materials.

One of the other known publications is U.S. application publication No. 20050178379 for "Alcohol gel fireplace burner," which discloses a device for creating a fire display in a fireplace, which comprises a noncombustible logset having a substantially rectangular shape and having an internal cavity communicating with an opening on a top surface of the noncombustible logset, and a rectangular fuel cartridge located in the internal cavity of the noncombustible logset, where a top opening of the fuel cartridge is aligned with the opening in the top surface of the noncombustible logset. The burner of this application is likely to have the same disadvantages when using gel alcohol as other such burners.

Another patent document published under publication No. 20110070551 for "Burner using alcohol as fuel" discloses a device, which uses an absorbent material filling in the internal space of the container such that when the alcohol level decreases and the alcohol burner is in use, chance of backfire situation is greatly reduced. The alcohol burner of this application has a container, a tracking plate on top of the container, a top cap on top of the sliding plate and a sliding plate slideably situated on top of the tracking plate to selectively close/open an opening defined in the tracking plate. There is also provided a bottom plate with a grill securely attached to the bottom face of the bottom plate to fix position of the absorbent. Because the sliding plate is separated away from the grill by both the tracking plate and the bottom plate, sufficient space is provided to the sliding plate to ensure that even there is deformation in the bottom plate, movement of the sliding plate is not influenced. Also, due to the limitation of the absorbent to the alcohol, when the alcohol burner is moved from one place to another, the alcohol spilling is said to be obviated to the minimum. The absorbent in the container may be made of ceramic material or cotton.

The design of the burner according to publication No. 20110070551 suffers from several shortcomings: the flame is likely to be weak, prone to premature shut-off because of insufficient vapor production and absence of a heat-conducting medium like metal to conduct heat down into fiber. Also, the burner will be difficult to light since there are no vapor holes down in wool; the planar grill does not create a visual depth in the flame pattern; the ceramic fiber absorbent is too deep, preventing evaporation from the lower portions of the container. While this device may work satisfactorily in certain circumstances, there is still a need for an alcohol burner that eliminates all of the safety hazards (fuel spill, flash ignition hazard, etc.) associated with previous existing devices that are used for portable alcohol fire features.

The present invention contemplates elimination of disadvantages of the prior art and provision of a spill-proof portable alcohol burner with increased safety characteristics.

SUMMARY OF THE INVENTION

It is, therefore, an object of the present invention to provide a portable alcohol burner that can be safely used indoors.

It is another object of the invention to provide a stand-alone insert that can be incorporated in a variety of aesthetically pleasing surrounds and placed on a table or other suitable surface.

It is a further object of the invention to provide a flame-producing unit that can be reloaded with liquid alcohol and reused numerous times.

It is still a further object of the present invention to provide an alcohol burner with improved safety characteristics.

These and other objects of the present invention are achieved through a provision of an alcohol burner assembly, which is designed to offer safe alternatives to conventional gas, liquid alcohol, or alcohol gel burners. The device has a portable hollow housing defining a fuel chamber filled with ceramic fiber filler and permeated with alcohol. A perforated baffle cage is fitted in the fuel chamber and is surrounded by the filler material. The baffle cage has a generally rectangular configuration with perforated bottom and upright walls. As alcohol vapors escape from the fuel chamber and rise through the perforations in the baffle cage they can be ignited to create a desired pleasing flame pattern. In the preferred embodiment, the ceramic fiber material is ceramic fiber wool capable of retaining liquid alcohol by surface tension, and alcohol is ethanol. Such surface tension on the wool fibers would facilitate the spill-proof aspect should the burner be turned on its side or upside down.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
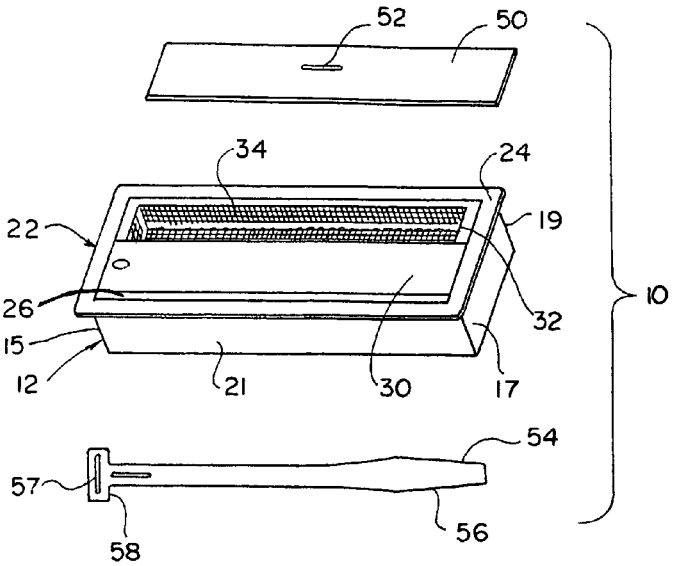
FIG. 1 is a perspective view of the alcohol burner assembly according to the present invention.
Figure 2:
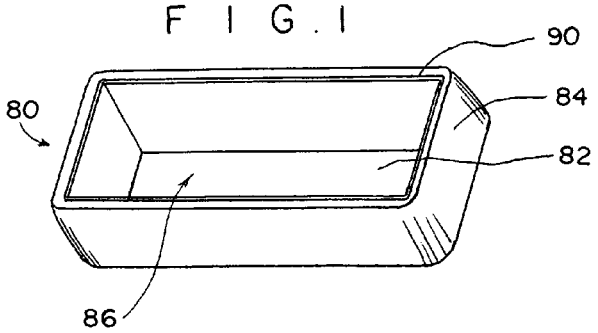
FIG. 2 is a perspective detail view of an optional heat-proof decorative surround for use with the burner assembly.

Turning now to the drawings in more detail, numeral 10 designates the alcohol burner assembly according to this invention. The assembly 10 comprises a portable hollow housing 12 having a closed bottom 14, a continuous upright sidewall 16, and a peripheral top edge 18. The housing illustrated in the drawings has a generally rectangular configuration although other configurations can be used if desired. When the rectangular configuration is contemplated, the sidewall comprises housing end walls 15, 17 and housing side walls 19, 21. The bottom 14, the housing end walls 15, 17 and the housing side walls 19, 21 define an interior fuel chamber 20.

A top plate 22 is secured to a top edge 18 of the housing sidewalls 19, 21 and the housing end walls 15, 17, covering the top of the housing 12. The top plate 22 is affixed by welding to a peripheral flange 24, which is dimensioned to be at least slightly greater than the dimensions of the housing sidewall 16. The top plate 22 is configured to rest on the top edge 18 of the sidewall 16 such that the peripheral flange 24 extends outwardly from the sidewall 16. In one aspect of the invention, the top plate 22 is adapted to extend transversely to a vertical axis of the housing 12 and transversely to the upright sidewall 16.

A transverse shoulder 26 is formed in the top plate 22 a distance from a peripheral edge 28 of the top plate. The shoulder 26 separates the flange 24 from a central portion 30 of the top plate 22; the central portion 30 extends at a vertical level slightly below the flange 24. The central portion 30 comprises an open portion 32, which is configured to receive a perforated baffle cage 34 therein. In one aspect of the invention, the baffle cage 34, the central portion 30 of the top plate 22 and the flange 24 are affixed together such as by welding or other similar mechanical means. In one aspect of the invention, the baffle cage extends to a depth of about one-half of the depth of the interior fuel chamber 20 so as to expose the baffle cage to the alcohol fuel close to the lower part of the fuel chamber 20.

The baffle cage 34 is formed as a perforated trough having a generally U-shaped cross-section. The baffle cage 34 comprises a bottom part 36, open top, and upright cage walls 38. The open top of the baffle cage 34 is substantially aligned with the open portion 32 formed in the top plate 22. In the embodiments where the baffle cage 34 has a generally open-top parallelepiped configuration with five walls: the upright cage walls 38, which comprises two parallel cage end walls 39, 40 and two parallel cage side walls 41, 42, which extend transversely to the cage end walls 39, 40 secured to the bottom part 36. A plurality of through openings 46 is formed in the bottom part 36, the cage end walls 39, 40 and the cage side walls 41, 42. The openings 46 facilitate air circulation between the atmosphere and the interior fuel chamber 20, as will be explained in more detail hereinafter.

Figure 3:
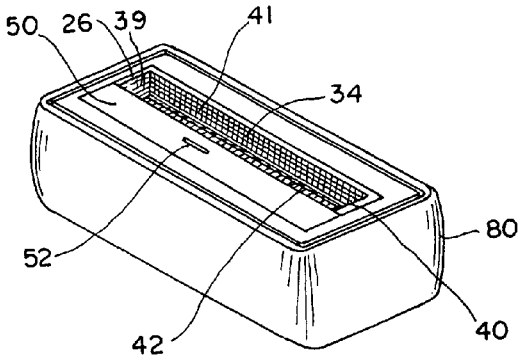
FIG. 3 is a perspective view of the burner assembly positioned in the decorative surround, with the baffle cover removed.
Figure 4:
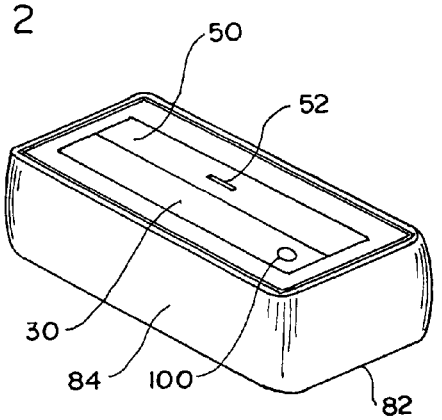
FIG. 4 is a perspective view of the burner assembly positioned in the decorative surround, with the baffle cover in place.

A detachable sliding baffle cover 50 is provided for selectively covering the top of the baffle cage 34 when the fire needs to be extinguished. The baffle cover 50 is configured to fit within the limits defined by the shoulder 26 and slide over the central portion 30 between an open position shown in FIG. 3 and a closed position shown in FIG. 4, covering the baffle cage 34. The baffle cover 50 has a thickness not generally exceeding the height or vertical dimensions of the transverse shoulder 26. When the baffle cover 50 is moved along the central portion 30 of the top plate 22 the baffle cover 50 frictionally engages the transverse shoulder 26 along its end portions without substantially extending above the flange 24. The instant invention uses a continuous line welding of the baffle cage 34 to the baffle plate or flange welded to the top plate 22. The sliding top-mounted cover allows for infinitely variable flame settings. Top mounting method reduces possibility of jamming the cover.

An indentation (or alternatively a knob) 52 is provided on to the top surface of the baffle cover 50. A snuffer wand 54 is provided for moving the baffle cover 50 between the open and closed positions. The snuffer wand 54 is a hand-held tool having a gripping portion 56 and a nose portion 58. The nose portion 58 is provided with an elongated slot 57, which configured to engage the knob 52 on the baffle cover 50. The user engages the knob 52 by aligning the slot 57 with the knob 52 and sliding the baffle cover 50 along the central portion 30 between an open and closed position. If the indentation is formed in the top of the baffle cover, the user applies the nose portion 58 to move the baffle cover between a closed and open position. It is envisioned that the wand 54 would be particularly useful when moving the cover 50 into a closed position since the baffle cover 50 will be hot at that time.

A pre-determined quantity of temperature resistant inorganic porous filler 60 is positioned in the interior chamber 20 formed in the housing 12. In one aspect of invention the filler 60 comprises ceramic fiber material, such as silica-alumina ceramic wool or other high temperature-resistance material having low thermal conductivity. The filler 60 surrounds the baffle cage on the bottom and sides thereof. The interior chamber is completely packed with the ceramic fiber filler—to absorb and store liquid alcohol and facilitate its conversion into vapor to fuel the fire.

The filler 60 is permeated with liquid alcohol, such as for instance ethyl alcohol or ethanol. The alcohol infiltrates the pores or interstices of the filler 60 and is retained therein by surface tension of the fibers. In one aspect, the alcohol selected for use in the apparatus of the present invention has evaporation temperature of about 78°-80° C. (172°-176° F.). The ceramic fiber has a much higher melting point, about 1648° C. (3000° F.). Thus, the fuel contained in the chamber 20 is allowed to vaporize and burn, while the ceramic fiber filler remains intact. In one of the preferred embodiments, the ceramic fiber was selected to have density (kg/m3) of 128.

As alcohol in the fuel chamber 20 is heated it vaporizes and mixes with ambient oxygen admitted through the baffle cage openings 46. Oxygen from the atmosphere moves in the direction of arrows 70, while the vapor, illustrated by lines 71, rises through the interior chamber 20 and through the baffle cage 34, as schematically shown by arrows 72 in FIGS. 5-7. The flames 74 escape the baffle cage creating a pleasing flickering effect and simulating log fire. Depending on the configuration of the baffle cage, the flame pattern can resemble an elongated log, a circle, an oval, or any other desired pattern.

Figure 5:
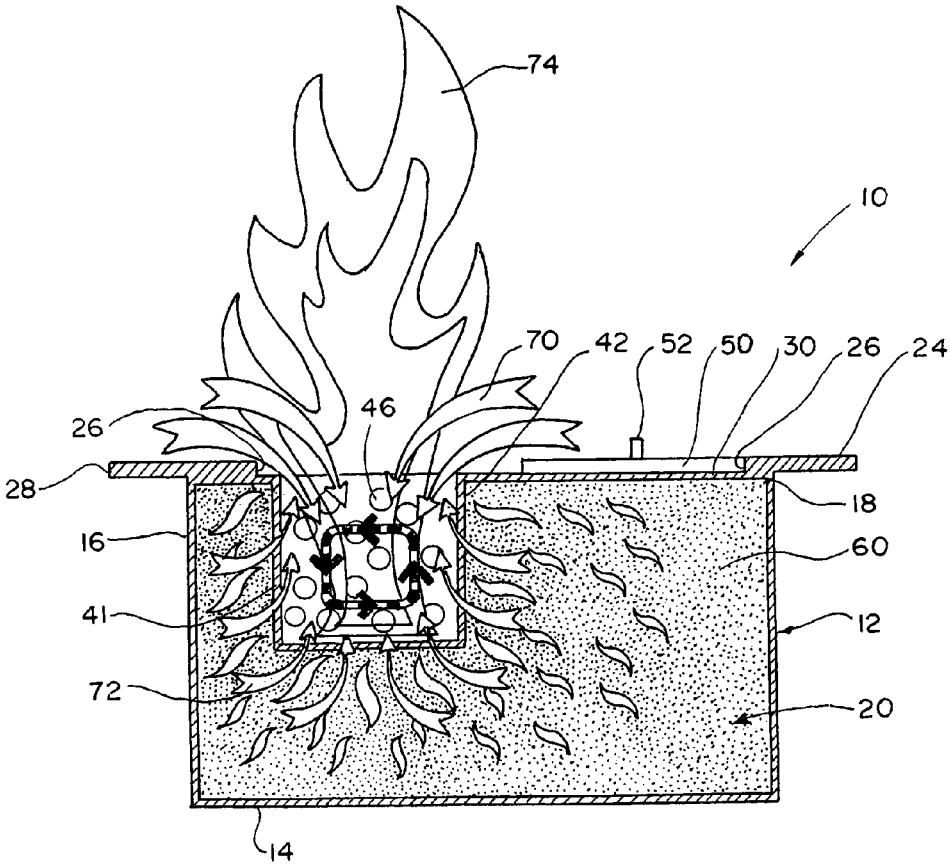
FIG. 5 is a schematic cross sectional view illustrating creation of the flames in the burner assembly.
Figure 6:
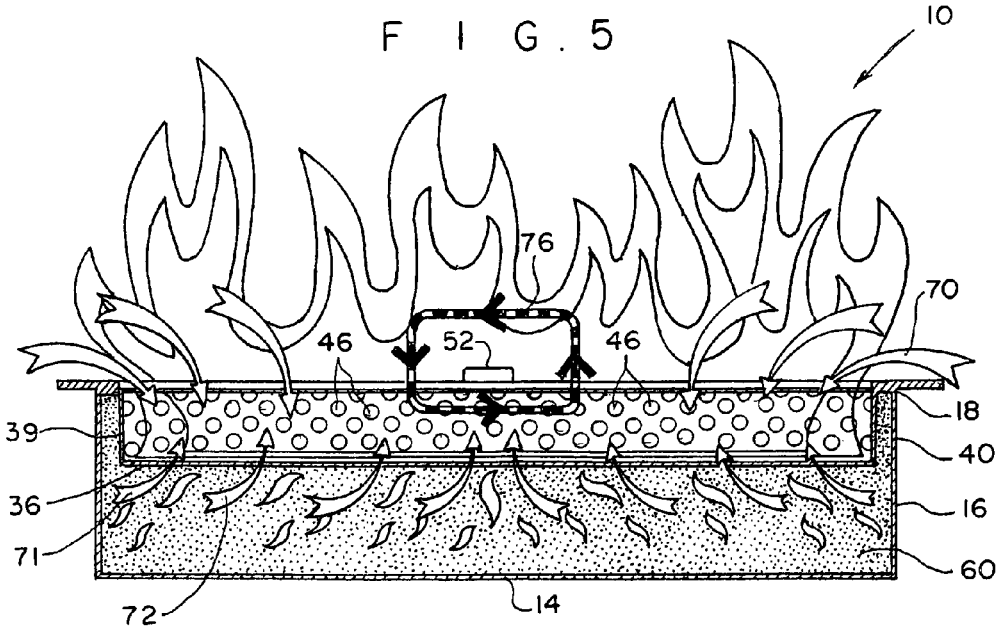
FIG. 6 is a schematic longitudinal section illustrating creation of radiant heat in the burner assembly.

The circulation of oxygen and vapor, schematically shown by arrows 76 in FIGS. 5 and 6, continues as long as there is fuel in the chamber 20 and the baffle cover 50 is open to admit oxygen into the baffle cage 34 to mix with the alcohol vapor. When the user desires to extinguish the flame 74, the user moves the baffle cover 50, using the wand 54 over the baffle cage 34 depriving the flames of oxygen. Then, the flames 74 are allowed to die down extinguishing the fire produced in the baffle cage 34.

When the alcohol retained in the filler 60 is ignited it heats the walls of the housing 12 and the baffle cage 34. If the assembly 10 is formed as a stand-alone unit that is not designed to be placed in a fireproof hearth, the present invention contemplates provision of an optional insulating enclosure. One type of such enclosure 80 is illustrated in FIGS. 2-4, and 7. The enclosure 80 can be formed from a variety of heat-resistant materials, such as ceramic, clay, tempered glass, etc. Depending on the shape and size of the housing 12, the decorative enclosure 80 can be formed as a rectangular body having a closed bottom 82 and a continuous upright wall 84, which substantially surround the bottom 14 and the sidewall 16 of the housing 12. The enclosure 80 has an open top 86 allowing the housing 12 to be positioned therein.

The enclosure 80 comprises a top portion 88 formed with a continuous groove 90 and an inwardly facing shoulder 92. When the housing 12 is placed in the enclosure 80, the flange 24 of the top plate 22 rests within the groove 90, supporting the housing 12 within the enclosure 80. The shoulder 92 prevents the flange 24 from moving outside of the perimeters defined by the top portion 88 of the enclosure 80, thereby preventing accidental spread of the flames in the room.

Figure 7:
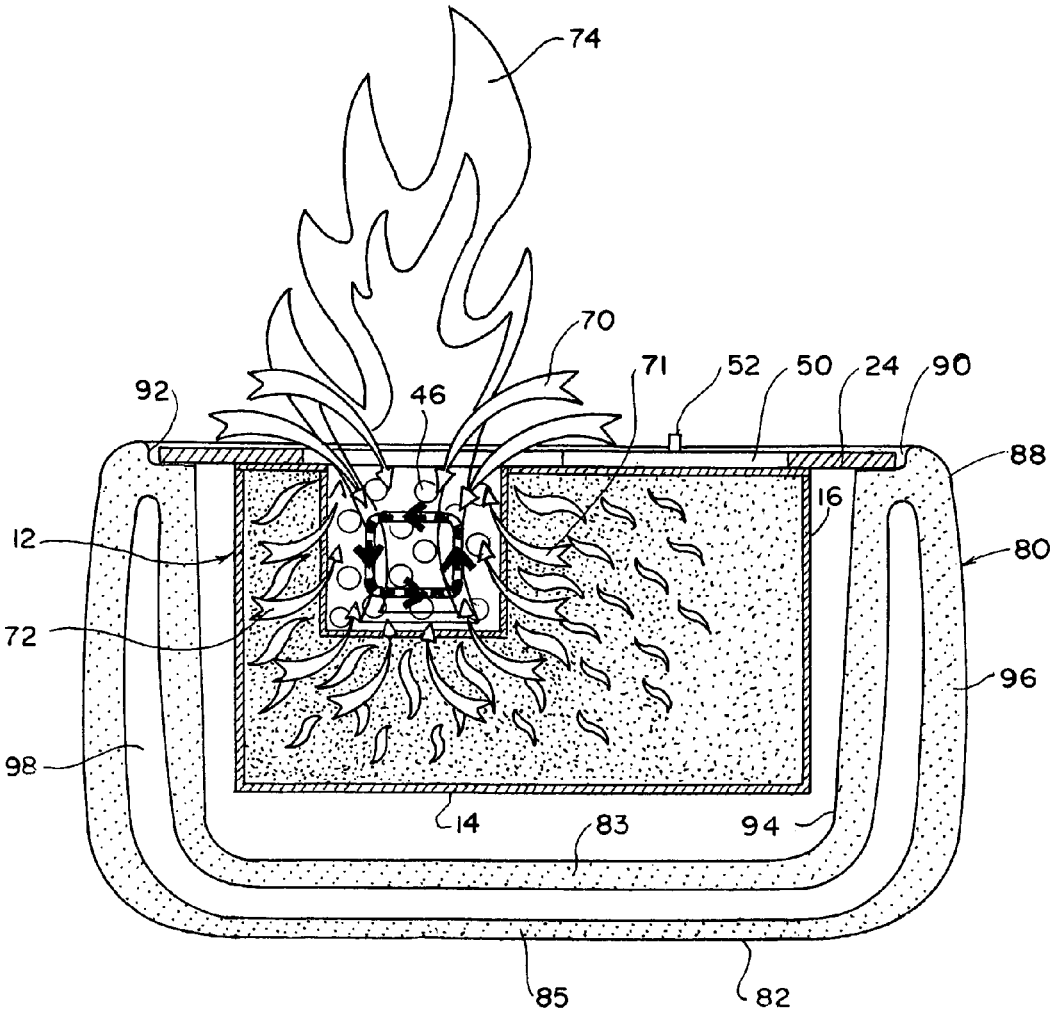
FIG. 7 is a schematic cross-section view of the burner assembly positioned within a decorative enclosure.
Figure 8:
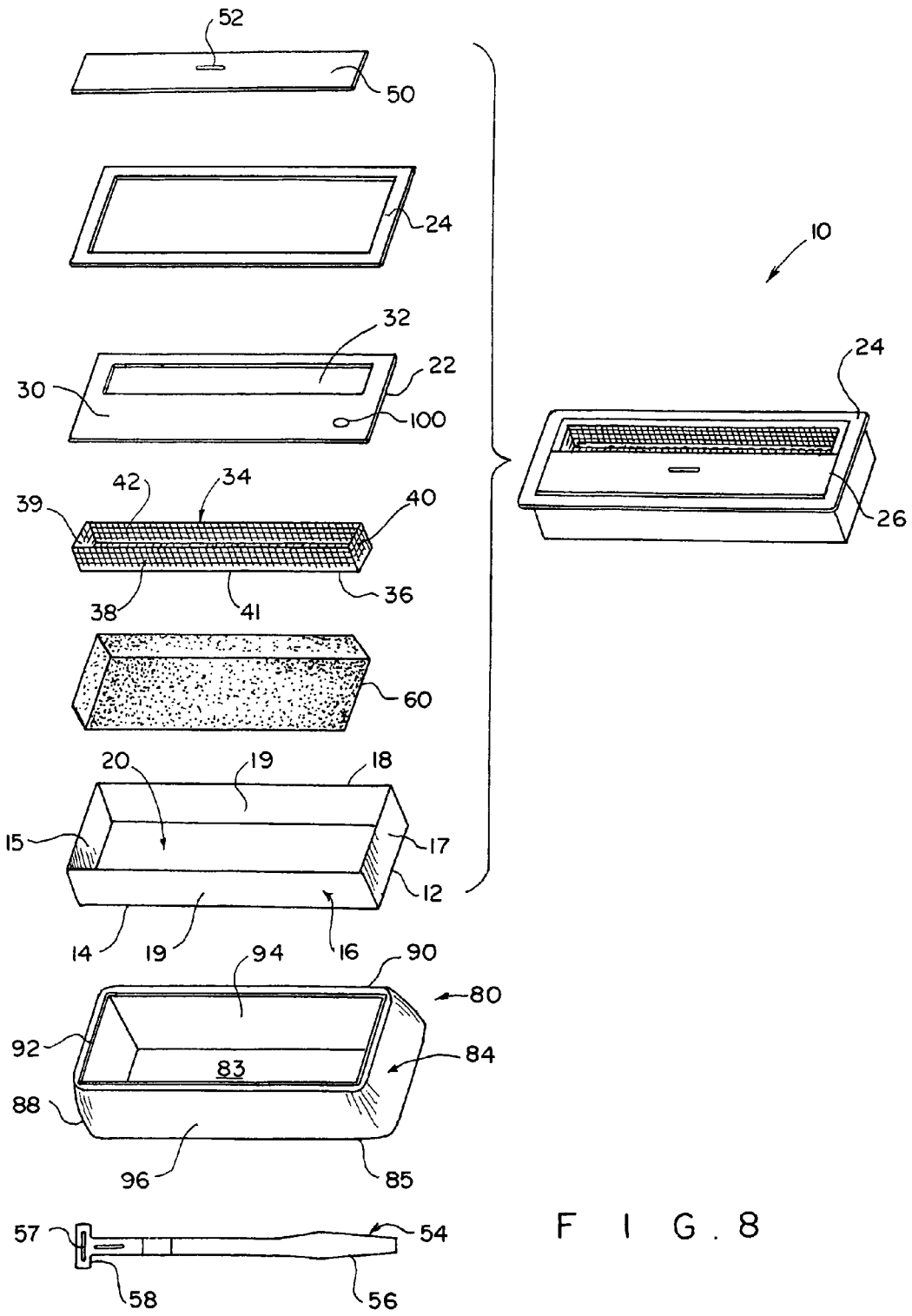
FIG. 8 is an exploded view showing the component parts of the burner assembly with an optional enclosure.

In the exemplary embodiment shown in FIG. 7, the enclosure 80 is formed with as a double-walled structure with an inner wall member 94 and an outer wall member 96. The bottom can also be formed as a double-part member, with the inner bottom member 83 and an outer bottom member 85. The top portions of the inner wall member 94 and the outer wall member 96 are joined in the top portion 88.

An enclosed gap 98 is formed between the inner wall members 94, 96 and the inner and outer bottom members 83, 85. In the specific embodiment of FIG. 7, the gap 98 is a continuous gap extending between the bottom members and the walls of the enclosure 80. In this embodiment, the enclosure 80 is dimensioned and configured to leave spaces between the inner wall 94 and the continuous sidewall 16 of the housing 12, as well as the inner bottom member 83 and the bottom 14 of the housing 12. In effect, the housing 12 is suspended within the enclosure 80 using the flange 24 that is configured to rest on the bottom of the groove 90.

Of course, other type of enclosure can be used, not necessarily double walled. For instance, the enclosure can be formed in a decorative style that resembles a plant, a volcano, a fictitious character, etc. The outer surface of the enclosure 80 can be decorated to appeal to the taste of consumers with drawings, geometric designs, etc. This exterior vessel holds the metal burner and contains its heat—allowing for the alcohol burner of this invention to be portable and placed in a wide variety of settings. The unique properties of this design include the dramatic heat insulation achieved by a combination of two factors: a) the ceramic fiber insulation of the burner's fuel chamber itself; and b) the double wall ceramic shell structure that creates an additional air chamber to further reduce unwanted heat transfer to the user and the surfaces of other nearby materials.

Although the use of double wall ceramic is not new—this application is unique in that it is the first use of such a design structure in combination with a metal insulated fireplace burner. The result is the first compact, portable ceramic fireplace that is safe for handling even immediately after use. When the burner has been a flame for four hours continuously, no part of the external surface of the ceramic vessel ever exceeds 120° F. (48.89° C.). The elegant and compact shape is the result of the perfect amount of air pockets within the walls of the ceramic vessel, and also inside the vessel between the metal burner and the ceramic surface.

An optional indentation 100 (FIG. 4) can be formed in the central portion 30 of the top plate 22. The indentation is configured to retain a small pre-determined quantity of scented oil. As the top plate 22 is heated the scented oil deposited into the indentation 100 is heated as well. The oil vaporizes filling the room with the scented oil odor.

The present invention contemplates provision of a method of generating a generally rectangular flame pattern using the assembly of the present invention as a wood log burning fireplace simulator. The assembly as described above is used in the method steps. The user positions the housing 12 in a fire-proof support, be it either a fireproof hearth behind artificial fire logs (not shown) or within the enclosure 80. The user then moves the cover 50 into an open position, exposing the open top of the baffle cage 34 and allowing some of the alcohol vapor from the fuel chamber 20 to escape through the openings 46 into the baffle cage 34. In the baffle cage, the alcohol vapor is allowed to admix with air.

The user then ignites the vapor by any desired means, such as a match or an electric lighter. The flames rise above the top plate 22 of the housing 12 creating the desired flame pattern. The shape of the baffle page, across which the flame is generated, facilitates creation of the generally rectangular flame pattern. Heat generated by the flames pulls oxygen from the atmosphere into the baffle cage 34, where it mixes with the alcohol vapor rising from the fuel chamber 20, thus creating a circulation pattern that will continue as long as the oxygen/alcohol vapor mixture is present in the baffle cage.

When the user desires to extinguish the fire, the user uses the wand 54 to move the heated baffle cover 50 over the open top of the baffle cage 34. Since the baffle cover 50 is configured to substantially cover the entire open top of the baffle cage, in effect sealing the baffle cage 34, the oxygen supply is terminated and the flame 74 gradually dies down. The user can repeat the process numerous times until the supply of alcohol in the fuel chamber 20 is exhausted. Additional alcohol can be added by pouring the alcohol through the openings 46 and allowing the alcohol to permeate the ceramic fiber pores in the fuel chamber 20.

There is obviously a delicate balance between the amount of fuel and the amount of oxygen to produce a colorful flame. If one were to supply sufficient oxygen to burn all the hydrocarbons in the alcohol, the flame may be a blue, almost invisible flame. However, by depriving the trough of some oxygen, a brilliant colorful yellow flame can be produced which by itself indicates a non complete combustion of the alcohol, but that is the objective, a colorful flame for aesthetic purposes. Therefore, the user may desire to move the baffle cover 50 into a partially closed position over the baffle cage 34 to regulate the flame pattern and color of the flames.

The assembly 10 of the present invention is portable and fuel efficient. It does not waste fuel by burning more than is necessary to achieve a visually appealing flame pattern. The assembly is also safe since the surface tension created by the ceramic fiber filler 60 prevents spilling of alcohol even if the assembly 10 is accidentally overturned or knocked down. Besides, the ceramic fiber filler completely occupies the fuel chamber and surrounds the baffle cage on four sides and the bottom. In the preferred embodiment the fuel chamber is large enough to accommodate sufficient fuel lasting 2 or 3 hours. The housing 12, the top plate 22 and the baffle cage 34 can be formed from a variety of heat-resistant materials, such as for instance stainless steel.

The alcohol fire burner of this invention has numerous distinguishing characteristics that set it apart from conventional alcohol burners, such provision of a core fuel chamber, which is stuffed with ceramic fiber and filled with liquid alcohol. The housing is more linear in its configuration (many prior models in market are rather square in configuration than rectangular and therefore less well suited to applications such as insertion in furniture or fireplace hearths) and many smaller gel and liquid burners are cylindrical in shape. The use of liquid ethyl alcohol makes it highly suitable for indoor or outdoor use, while gel is not, and natural gas is not, unless its exhaust is vented through a chimney or otherwise filtered.

The alcohol burner of this invention is capable of producing between 1,000 btu and 10,000 btu—and all energy remains in the area, where the burner is positioned; it is not lost in the chimney. A setting of 6,000 to 8,000 btu is preferable for periods of more than an hour in a living room setting. Tests illustrated that at the highest setting, burning for more than about 45 minutes, the instant burner is capable of producing more heat than then could be desired by an average consumer.

Liquid alcohol formulated for alcohol fire burners is almost exclusively made from ethyl alcohol—primarily from food crops or other organic farm matter (switch grass, etc.). Because of the source material, this fuel burns far more cleanly than gel alcohol—which is almost always made from isopropyl alcohol. The preliminary tests conducted with the alcohol burner of the present invention demonstrated that the flame produced by the burner has a lively movement and varied flame height and strength, which appear more natural than the fixed, steady burn from a fixed gas line fireplace.

When compared to the alcohol burner of publication No. 20110070551, the present invention presents numerous advantages. The baffle cage creates a controlled combustion chamber area. The ceramic fiber layer is sufficient to create enough heat projected down into the wool to encourage evaporation from lower area of the housing. In the design of the published application, No. 20110070551, it is likely that the fire will self extinguish long before the fuel is exhausted—and the flame will appear weak for a considerable period of time. In contrast, the baffle cage of the instant invention, being suspended below the top plate into the housing delivers created heat deep in the ceramic wool filler.

It also appears that the surface area of the grill used in publication No. 20110070551 may be inadequate. By laying it across the surface, and not creating a five-sided baffle cage, as is disclosed in the instant application, the design of the published application severely limits the baffle surface, through which the vapors escape. The flame production in that design would therefore be inferior, difficult to light and be prone to premature self extinguishing.

Furthermore, there is no evidence that a sealed fuel storage area has been created in the burner design of publication No. 20110070551. The fastening of the top plate to the side walls is critical for preventing leakage of gas and liquid fuel. The instant invention uses a continuous line welding of the baffle cage to the baffle plate welded to top plate.

Conventional liquid alcohol burners hold their fuel in liquid form and can easily spill fuel—creating great fire hazard risk. In contrast, the present invention uses porous ceramic wool filler that is permeated with alcohol, thus preventing live flame spill if dropped or tipped. The five-wall baffle cage and the depth of the baffle cage inside the fuel chamber are all important factors that cause the correct flow of fresh air into the combustion area of the baffle. These unique features are responsible for creation of a lively flame which peaks and drops in a random pattern according to the way fresh air is drawn into the baffle chamber. As a result, individual flame points of varied height, depth, brightness and strength are created that are far more natural to the human eye than a fixed gas line fireplace which simply burns the fuel as it is released from the holes along a cylindrical tube (mechanical looking flame). Many conventional alcohol burners also fail to create this optimal control over the blending of fuel vapor and oxygen.

The sidewalls of the instant burner are well insulated by the ceramic wool, other burners suffer from extreme heat transfer, making them more dangerous to handle, and also limited where they can be installed. The ceramic wool filler retains the metal surfaces of the instant burner much cooler than has ever been possible before.

The instant invention eliminates the risk of forming pockets of trapped alcohol vapor through its novel closed fuel storage compartment that prevents such vapor clouds from existing. The material used and the density of its packing ensures the optimal amount of fuel absorption and safe storage. Other known burners are prone to fuel leaking out of seams and connection points—creating fire hazard. These leaks either emit liquid fuel or else fuel vapor, which is combustible. The instant invention eliminates this risk by employing a sealed fuel storage compartment that is welded closed, with a continuous line welding seam on all sides save for the controlled fuel combustion chamber created by the baffle cage. Because of the construction, location and size of the specially designed compartment, risk of flash flare, unintended leakage or outright spillage is prevented.

Other burners allow for the surface of the liquid alcohol to be ignited. This presents several problems since the ratio of fresh air to fuel cannot be controlled. Depending on the amount of fuel that is in the fuel reservoir of typical burners, there can either be an excess or an inadequacy of fresh air to mix with the fuel vapor. The quality of flame produced is therefore not consistent and often not desirable to users. As the fuel level drops, the amount of flame visible above the top of the burner is reduced, and the user cannot enjoy the viewing of the entire flame produced (a portion of it is hidden inside the burner). The instant invention solves this problem by restricting the area of combustion to a controlled space near the surface of the burner and creating the optimal, steady mix of air and vapor producing the most lively, natural and aesthetically pleasing flame achieved by any alcohol burner.

The baffle cage 34 creates a contained area for the combustion of fuel vapor only (but not liquid fuel). Since liquid alcohol is stored in densely packed ceramic fiber, there is insufficient air capable of entering enter the interior chamber 20—and therefore no fire can occur inside the burner. This forces the warm fuel vapor into the combustion area of the baffle cage—producing a controlled and even flame. All known models on the market do not have this feature—the most common type allows for liquid to burn freely inside the burner in an open air liquid fuel storage tank. Another type of an alcohol available on the market uses a wick effect to force the fire to the top surface of the burner—only slightly separated away from the open air liquid fuel tanks. Neither of these solutions can match the safety nor the flame quality of the contained baffle basket combustion area.

A linear flame is generally considered to be preferable in home settings to square or round flame openings. Round fire shapes are generally associated with outdoor fires such as fire pits or bonfires, whereas linear flame shapes are common with all types of indoor fires—ranging from modern gas fires to traditional log fires. Many other alcohol burners are configured in a square box shape or a round can. The instant invention has achieved the desired linear effect in the most compact and efficient appliance to date—enabling users to easily incorporate a linear flame into much smaller areas than ever before—including smaller hearth settings, custom furniture build-ins, or compact portable stand alone housings. Without the feature of our shallow, recessed, rectangular baffle cage, this would not be possible to the same degree.

The configuration of the baffle cover allows for easy adjustment of flame size and heat output. Many other burners employ an under mounted door system that is prone to a) leakage of vapor and b) jamming or sizing during use due to heat expansion. The cover system of this invention eliminates these problems while still allowing full control over the fire.

During manufacturing, the baffle cage 34 is formed of five sides of perforated stainless steel, which are soldered together to form a basket—which is then soldered firmly in place to the top (baffle) plate—which is in turn soldered to the housing 12—thus permanently fixing the ceramic fiber filler 60 into place. Because the top plate is then welded to the rest of the parts, using a continuous welding method (Tig welding rather than spot Mig welding), a sealed chamber that can store the liquid fuel without it spilling out is created. Also, air cannot get in, nor can the fire leak out of—any area other than the baffle cage combustion area. This is unique to the instant invention design and is an important factor that makes the instant burner superior to all others on the market.

The assembly of parts is as follows:

pack ceramic fiber filler 60 into interior fuel chamber 20;

weld the baffle cage 34 to the top plate 22;

weld the flange 24 to the top plate 22;

weld the top plate 22 to the housing 12—permanently sealing the ceramic fiber filler and baffle cage into place; and place the sliding baffle cover 50 into the top plate cavity to open and close flame (using snuffing wand tool 50).

Since the combustion area is located down inside the ceramic wool filled chamber, this causes the ideal amount of heat to be exchanged to surrounding materials of metal and fiber—and this ensures even production of fuel vapor from the liquid alcohol stored in the adjacent fiber. It is only by locating the combustion area inside the ceramic wool filler and below the top plate surface—rather than on top of it—that a continuous, efficient and attractive flame can be produced over an extended period of time of three or more hours.

By packing the housing inner chamber completely with ceramic fiber filler and then welding it closed, the instant burner greatly reduces the heat transfer from the body of the burner to surrounding materials. Other burners are so hot at sides of the fuel pan (because combustion is taking place inside the liquid fuel storage area)—that the burners require additional layers of insulation or protection around them to contain the heat they put off laterally. However, this design is self-insulating at the fuel chamber and forces all heat to the top surface.

Many changes and modifications can be made in the design of the present invention without departing from the spirit thereof. I, therefore, pray that my rights to the present invention be limited only by the scope of the appended claims.

I claim:

1. A method of producing a generally rectangular flame pattern in an alcohol burner, comprising the following steps:

providing a hollow housing having a fuel chamber defined by a closed bottom plate, a continuous upright sidewall secured to the bottom plate and extending upwardly therefrom, and a top plate resting on said upright sidewall, said top plate being provided with a generally rectangular opening;

providing a substantially rectangular baffle cage mounted in the fuel chamber and extending to about one-half depth of the fuel chamber, said baffle cage being provided with a plurality of perforations in a bottom and side walls of the baffle cage and an open top substantially aligned with the rectangular opening of the top plate;

providing a ceramic fiber filler deposited in the fuel chamber in a surrounding relationship to the baffle cage, said filler being permeated with liquid alcohol;

allowing alcohol vapor to escape from the fuel chamber into the baffle cage and admix with air; igniting the alcohol vapor in the baffle cage, thereby creating a generally rectangular flame pattern escaping the baffle cage; and providing a means of extinguishing flames in the baffle cage, said means for extinguishing the flames comprising a step of providing a baffle cover and positioning the cover for sliding movement over the top plate, moving the baffle cover over the rectangular opening, thereby preventing air from entering the baffle cage.

2. The method of claim 1, further comprising a step of providing wand configured for engaging the baffle cover and moving the baffle cover along the top plate between the open and closed positions.

3. The method of claim 1, wherein the top plate comprises a central portion and a peripheral flange extending outwardly from the central portion, wherein a transverse shoulder is formed between the central portion and the peripheral flange, and wherein the baffle cover is configured to frictionally engage the transverse shoulder without substantially extending above the peripheral flange.

4. The method of claim 3, wherein at least a portion of said peripheral flange extends outwardly and transversely to, the upright sidewall of the housing.

5. The method of claim 1, wherein said baffle cage has a generally U-shaped cross-section.

6. The method of claim 1, wherein said filler is configured to retain liquid alcohol by surface tension.

7. The method of claim 1, wherein said ceramic fiber filler is formed from a material having a melting point of about 3000 degrees Fahrenheit.

8. The method of claim 1, wherein the ceramic fiber filler is formed from a material capable of retaining liquid alcohol in the filler by surface tension.

9. The method of claim 1, wherein the liquid alcohol is selected from a material having a evaporation temperature ranging from about 172 degrees to 176 degrees Fahrenheit.

10. The method of claim 1, further comprising a step of providing a protective enclosure configured to receive the housing therein, said enclosure comprising a top peripheral portion, and wherein the flange is configured to rest on the top peripheral portion suspending the housing within the enclosure.

11. A method of producing a generally rectangular flame pattern in an alcohol burner, comprising the following steps:

providing a hollow housing having a fuel chamber defined by a closed bottom plate, a continuous upright sidewall secured to the bottom plate and extending upwardly therefrom, and a top plate resting on said upright sidewall, said top plate being provided with a generally rectangular opening;

providing a substantially rectangular baffle cage mounted in the fuel chamber and extending to about one-half depth of the fuel chamber, said baffle cage being provided with a plurality of perforations in a bottom and side walls of the baffle cage and an open top substantially aligned with the rectangular opening of the top plate;

providing a ceramic fiber filler deposited in the fuel chamber in a surrounding relationship to the baffle cage, said filler being permeated with liquid alcohol;

allowing alcohol vapor to escape from the fuel chamber into the baffle cage and admix with air;

providing a protective enclosure configured to receive the housing therein, said enclosure comprising a top peripheral portion, and wherein the flange is configured to rest on the top peripheral portion suspending the housing within the enclosure, wherein the enclosure comprises a closed bottom member, an open top and an upwardly extending sidewall member secured to the bottom member, said bottom member comprising an inner bottom part and an outer bottom part spaced from the inner bottom part, and wherein the sidewall member comprises an inner sidewall part and an outer sidewall part spaced from the inner sidewall part, said inner sidewall part being secured to the inner bottom part, and the outer sidewall part being secured to the outer bottom part.

12. The method of claim 1, further comprising a step of providing an indentation in the top plate and depositing a pre-determined quantity of a scented material therein, said material vaporizing when heated by the flames created in the baffle cage.

* * * * *